United States Patent [19]

Kwok et al.

[11] 4,109,834

[45] Aug. 29, 1978

[54] CONSTANT VOLUME FLUID DISCHARGING DEVICE

[75] Inventors: Clyde C. K. Kwok, Montreal; Essam A. Farag, Pointe Claire, both of Canada

[73] Assignee: Canadian Patents and Development Limited, Ottawa, Canada

[21] Appl. No.: 766,126

[22] Filed: Feb. 7, 1977

[30] Foreign Application Priority Data

Mar. 15, 1976 [CA] Canada ..... 247879

[51] Int. Cl.[2] ..... G01F 11/28

[52] U.S. Cl. ..... 222/448; 137/390; 137/410

[58] Field of Search ..... 137/389, 390, 410, 449; 222/42 S, 448, 3, 424.5; 4/69, 57 R, 56

[56] References Cited

U.S. PATENT DOCUMENTS 1,004,707 10/1911 Stewart ..... 137/410

3,466,672 9/1969 McGatee ..... 4/57 R

*Primary Examiner*—Robert B. Reeves
*Assistant Examiner*—H. Grant Skaggs
*Attorney, Agent, or Firm*—Ronald G. Bitner

[57] ABSTRACT

A device for discharging a constant volume of fluid which is relatively simple in construction and requires little space. The device comprises a cylindrical chamber with a tangential inlet to induce vortical fluid motion. Within the chamber is a ball having a specific gravity different from that of fluid and adapted to block an outlet which is disposed at the vertex of a cone-like surface disposed at one end of the chamber. When displaced from the outlet by a suitable mechanism, a combination of fluid and gravitational forces cause the ball to follow a spiral path and return to block the outlet, having discharged a certain amount of fluid. Two embodiments are described utilizing a ball having a specific gravity greater than, and less than, that of the fluid.

2 Claims, 4 Drawing Figures

CONSTANT VOLUME FLUID DISCHARGING DEVICE

BACKGROUND OF THE INVENTION

This invention relates to a fluid control device for discharging a constant volume of fluid.

In many systems involving fluids, it is necessary or desirable to have a device capable of discharging a constant volume of fluid. A common apparatus which utilizes such a device is the flushing unit of a water closet.

There are many devices which function as constant volume fluid flow valves. These include gravity flush tanks and more complex control valves utilizing timers, diaphragms, springs or compressed air.

The previous devices have limitations and disadvantages. For example, gravity flush tanks are large in size and require, in addition, a mechanical control system such as a float valve and plug system. Other constant volume control valves are complex or require high manufacturing precision.

SUMMARY OF THE INVENTION

An object of the present invention is to provide a novel device for discharging a constant volume of fluid.

Another object is to provide a constant volume control device that is structurally simple and inexpensive.

Another object is to provide a constant volume control device that occupies little space.

The present invention provides a constant volume discharging device comprising: a housing having a cylindrical cavity with an inlet connected tangentially to effect vortical motion of fluid in the cavity; a spherical valve member having a specific gravity different from that of the fluid disposed in the cavity; one end of the cavity, to which the valve member tends to gravitate, has a cone-like surface with a downwardly directed vertex; an outlet at the vertex is adapted to be blocked by the valve member; means interrupting travel of the valve member along a spiral path on the cone-like surface thereby allowing it to block the outlet; and means to displace the valve member from the outlet to initiate a discharge cycle.

In one embodiment the valve member has a specific gravity less than that of the fluid, and the cone-like surface is convex. Travel of the valve member is interrupted when it approaches the outlet.

In another embodiment the valve member has a specific gravity greater than that of the fluid, and the cone-like surface is concave. Travel of the valve member is interrupted by an obstacle disposed on the concave surface at the inlet.

DESCRIPTION OF PREFERRED EMBODIMENTS

Figure 1:
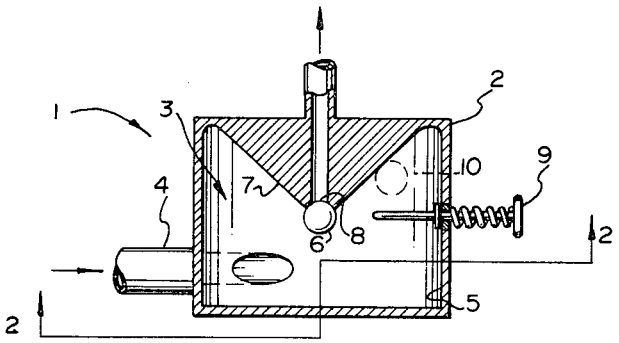
FIG. 1 is a schematic sectional elevation of one embodiment of a constant volume discharging device according to the present invention.
Figure 2:
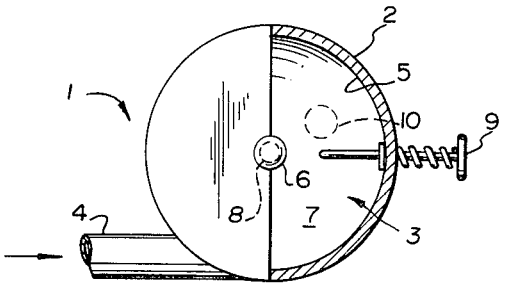
FIG. 2 is a partly sectional bottom view of the apparatus of FIG. 1 taken at 2—2.

Referring to FIGS. 1 and 2, the constant volume fluid discharging device 1 comprises a housing 2 having a cylindrical cavity 3. An inlet 4 communicates with the cavity 3 tangential to the cylindrical wall 5 of the cavity 3. Within the cavity 3 is a spherical valve member or ball 6. The cavity 3 at the top end has a convex surface 7 with a downwardly directed vertex. An outlet 8, disposed at the vertex, is adapted to be blocked by the valve member 6. Attached to the housing is a device 9 for displacing the ball 6 from its seat at outlet 8 thereby initiating a discharge cycle. In the embodiment of FIGS. 1 and 2, the ball has a specific gravity less than that of the fluid.

In operation, with reference to FIGS. 1 and 2, the initial condition of the device can be assumed to be as shown with the ball 6 blocking the outlet 8. To initiate the discharge cycle, the ball 6 is displaced from its seat by means of the mechanism 9, and fluid discharge through outlet 8 begins. As discharge proceeds, flow into the tangential inlet 4 imparts vortical motion to the fluid in the cavity 3. Buoyant forces on the ball 6 cause it to gravitate upward and outward along the convex surface 7. At the same time the vortical motion causes the ball to rotate within the cavity imparting a centripetal force on it which gets larger as velocity increases. Ultimately, the centripetal force component becomes larger than the component of the buoyant force and the ball moves in a spiral path downward and inward along the convex surface 7 towards the outlet 8. An intermediate position of the ball is designated 10. When the ball approaches the outlet 8, partial blockage of the outlet produces a pressure difference which terminates spiral travel of the ball and seats it firmly against the outlet, blocking discharge and completing the cycle.

The amount of fluid discharged during the cycle is determind by various factors such as the geometrical dimensions of the device, the difference in specific gravity between the ball and fluid and the supply pressure.

Figure 3:
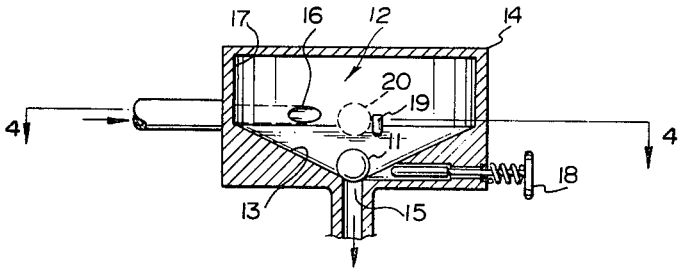
FIG. 3 is a schematic sectional elevation of another embodiment of the invention.
Figure 4:
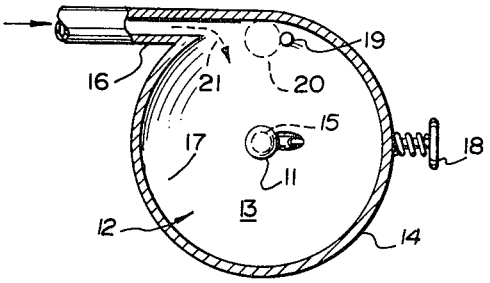
FIG. 4 is a sectional plan view of the apparatus of FIG. 3 taken at 4—4.

The embodiment of FIGS. 3 and 4 is similar in principle to the previous embodiment except that it utilizes a ball 11 having a specific gravity greater than the fluid. In this embodiment, the cavity 12 defines a concave surface 13 at the bottom end of the housing 14, with outlet 15 at the vertex. As in the previous embodiment, the inlet 16 is connected tangentially with the cylindrical wall 17, and a suitable mechanism 18 is provided to displace the ball 11 from the outlet 15. An obstacle 19 is disposed on the upper portion of the concave surface 13, in front of the inlet 16, to interrupt travel of the ball 11 as described hereafter.

In operation, with reference to FIGS. 3 and 4, the discharge cycle begins by displacing the ball 11 from its seated flow-blocking position, as shown. As discharge begins, the vortical flow within the cavity carries the ball 11 along the concave surface in a spiral path upward and outward until its travel is interrupted by the obstacle 19, causing it to pause momentarily in front of the inlet in the designated position 20. In this position, the ball 20 diverts the inlet flow 21 reducing the vortical motion of the fluid. The reduction of vortical fluid forces and the loss of centrifugal forces on the ball, allow the ball to return to block the outlet 15, and end the discharge cycle. The amount of fluid discharged is determined by the location of the obstacle, in addition to the criteria referred to with reference to FIGS. 1 and 2.

The embodiment of FIGS. 3 and 4 is suitable for gases and liquids. However, the embodiment of FIGS. 1 and 2 is best suited for liquids since it may not be practical or possible to provide a valve member having a specific gravity less than certain gases.

What is claimed is:

1. A constant volume fluid discharging device comprising:

a. a housing having a cylindrical cavity with a substantially vertical oriented longitudinal axis, said cavity having an upper and lower end, the upper end having a convex surface with a downwardly directed vertex;

b. an inlet connected substantially tangentially to a cylindrical wall of the cavity operative to effect vortical motion of fluid in the cavity;

c. a spherical valve member having a specific gravity less than that of the fluid disposed in the cavity;

d. an outlet at the vertex of the convex surface adapted to be blocked by the valve member; and e. means for displacing the valve member from the outlet for initiating a discharge cycle.

2. A constant volume fluid discharging device comprising:

a. a housing having a cylindrical cavity with a substantially vertical oriented longitudinal axis, said cavity having an upper and lower end, the lower end having a concave surface, with a downwardly directed vertex;

b. an inlet connected substantially tangentially to a cylindrical wall of the cavity operative to effect vortical motion of fluid in the cavity;

c. a spherical valve member having a specific gravity greater than that of the fluid disposed in the cavity;

d. an outlet at the vertex of the concave surface adapted to be blocked by the valve member;

e. an obstacle disposed on an upper outer portion of the concave surface in front of the inlet; and f. means for displacing the valve member from the outlet.

* * * * *